United States Patent [19]

Hrabák

[11] Patent Number: 4,562,677

[45] Date of Patent: Jan. 7, 1986

[54] METAL DOOR FRAME CONSTRUCTED OF A CHANNEL SECTION AND METHOD OF MAKING SAME

[75] Inventor: Frantisèk Hrabák, Pilsen, Czechoslovakia

[73] Assignee: Stavebni Strojirenstvi a Lehka Prefabrikace Generalni Reditelstvi, Prague, Czechoslovakia

[21] Appl. No.: 559,316

[22] Filed: Dec. 8, 1983

[51] Int. Cl.[4] ..... E06B 1/04

[52] U.S. Cl. ..... 52/211; 52/658; 29/155 R

[58] Field of Search ..... 52/211, 658; 49/504; 29/155 R

[56] References Cited

U.S. PATENT DOCUMENTS

| | | | |
|---|---|---|---|
| 1,925,804 | 9/1933 | Hiering | 52/658 X |
| 3,769,773 | 11/1973 | Mochizuki | 52/211 X |
| 4,446,667 | 5/1984 | Hertel | 52/658 |

*Primary Examiner*—Carl D. Friedman

[57] ABSTRACT

Metal door frame and the like made of channel iron open from outside without any need of welding or other kind of connections of jambs and upper part, and method of their manufacture. The jambs and header of the frame are made of a single part of a rolled channel iron having a complicated, asymmetrical shape generally in the form of a letter "U". In the area of a corner, the channel iron is provided, on walls which are perpendicular to the inner side of the door frame, with suitable cut-outs shaped as a triangle and a trapezoid for making it possible to bend the channel iron into a right angle corner. The superfluous material in the plane of the channel iron, forming the inner sides of the door frame and in other planes parallel to it, forms, after having bent the channel iron into corner, tongues, which may protrude from the frame for a better fixing of the door frame in the brickwork. Some of the tongues, or all of them, may be bent, respectively, toward the jambs and toward the header of the door frame for a better tightening of the bent corners between successive parts of the frame.

7 Claims, 5 Drawing Figures

METAL DOOR FRAME CONSTRUCTED OF A CHANNEL SECTION AND METHOD OF MAKING SAME

The invention relates to a metal door frame made of a channel section, the channel section being open to the outside and having the general shape of a broad U and shapes derived from it, the jambs and header or lintel being formed from one channel section. The invention also relates to a method of manufacturing such door frame.

Hitherto known metal door frames consist of two jambs, an upper part, and a sill with perpendicular or beveled corner contacts between successive parts of the frame. These parts are connected together by welding; in this way welding flash is produced; such flash must be removed because of aesthetic and safety reasons. The welding of parts of the door frame, as well as the removing of welding flash, requires the expenditure of much power and labor.

Other hitherto known metal door frames consist of similar parts, which are, in the zones of connection, overlapped and mutually suitably connected e.g. by spot welds. These door frames require more material and more work than does the first described prior art door frame.

Other hitherto known door frames consist of the same parts as the above-described prior door frames, but they are connected by means of angle irons. Disadvantages of these door frames are the requirement for more material and the requirement for additional labor in manufacturing them.

The above-mentioned drawbacks of the prior art are obviated by the metal door frame made of channel iron open to the outside according to the invention. In accordance with the invention, both jambs and the header or lintel of the frame are made of a single member in the form of channel iron, the channel being bent in the shape of a broad inverted U. In the preferred embodiment of the invention here described and claimed, the channel iron from which the frame is made is asymmetrical in cross-section, such cross-section being generally in the shape of a broad U. Assuming that such broad U is in upright position, the broad bottom of the U is at least generally flat or plane, and forms the portions of the parts of the door frame which are to define the opening therethrough. Arising from one longitudinal edge of such bottom, there is an upright flange and then a horizontal laterally inwardly bent flange. On the other edge of the broad bottom of the channel there is a second upright longitudinally extending flange of somewhat less height than the first vertical flange on the first edge of the channel. From the upper edge of such second upright flange there extends laterally a horizontal longitudinally extending flange; from the outer edge of such laterally extending flange there rises a third, shallow upright portion of the channel, such third upright portion of the channel terminating in a horizontal laterally inwardly extending longitudinal flange.

Such configuration of the channel iron from which the door frame is to be made is imposed by the specifications of the frame. The problem to be solved by the present invention is to be provide a door frame wherein the jambs and the header or lintel are integral, wherein the forward and rear parts of the jambs and header of the frame meet along single closed angularly disposed lines, and wherein the excess metal in the channel between the forward and rear portions of the frame are formed into frame strengthening folded portions which, in some embodiments of the invention, may extend outwardly of the frame to serve as frame locating means which interlock with other elements of the building structure in which the frame is affixed.

Such problem is solved, in accordance with the illustrative preferred embodiment of the invention, by providing a first opening, in the first vertical flange, in the form of an isosceles trapezoid having its lower and upper boundaries parallel and disposed respectively at the upper surface of the broad main bottom portion of the channel and the junction between the first upright wall or flange of the channel and the first inwardly bent horizontal flange thereon. The sides of such isosceles trapezoid are inclined in opposite directions so as to converge upwardly, such sides forming angles of 45° with respect to the broad horizontal base of the channel. Such first isosceles trapezoidal opening is disposed in the first upright flange of the channel generally centrally with respect to a transverse line of bend across the channel.

In the second, opposite upright flange, disposed on the other edge of the main bottom part of the channel, there is formed a second opening of isosceles trapezoid shape which is similar to the isosceles trapezoid opening in the first upright flange on the channel, and is located in a same manner but opposite to, the first isosceles trapezoid opening. Such second trapezoid opening differs from the first such opening only in that it is of lesser height than the first such opening. Thus the bottom of the second isosceles trapezoid opening is located at the juncture between the main bottom portion of the channel and the second upright flange thereon, and the upper edge of the second isosceles trapezoid opening is located at the junction between the second upright flange on the channel and the second, outwardly bent longitudinally extending flange thereon. The second isosceles trapezoid opening is located symmetrically with respect to said transverse line of bend to be made in the channel, and the opposite generally vertically extending walls thereof upwardly converge at equal opposite angles of 45° with respect to the main bottom portion of the channel.

A third opening, this one of isosceles triangular shape, is disposed in the third upright flange portion which extends longitudinally of said second side edge of the channel. Such isosceles triangular opening extends from its base at the junction between the second laterally extending flange on the channel and the third upright extending portion on the channel to the apex of such opening disposed at the intersection between said third upright flange thereon and the third inwardly extending horizontal flange at said second edge of the channel. The isosceles triangular opening has its apex disposed in the vertical transverse plane through the channel section which contains the line of the bend to be made therein as well as the center points of the bases of the above-described openings of isosceles trapezoidal shape made in the first and second vertical longitudinally extending flanges of the channel.

Advantageously the surfaces of the channel iron, lying in the corner of the door frame in the plane of the channel, form the inner side of the door frame which lies in planes parallel to the plane of the channel, form the inner part of the door frame, and are limited by the length of the hypotenuse of the rectangular isosceles triangle, and also by the base of the cut-outs which are shaped as isosceles trapezoids; the latter form, in the corner of the door frame, tongues or folded formations disposed at an angle of 135° with respect to the adjacent jamb and with respect to the header or lintel of the frame.

It is advantageous to form the tongues at the corners of the door frame in the plane of the upper part or lintel of the frame in such a way that they form its prolongation.

Another advantageous arrangement is with tongues in the corner of the door frame alternatingly deviated to the adjacent jamb and to the header or lintel.

Another advantageous arrangement is to have at least one tongue, forming the prolongation of the plane of the upper part or lintel of the frame, and the remaining tongues being bent alternatingly toward the adjacent jambs and toward the lintel.

Advantageously the metal door frame made of channel iron open from the outside is manufactured so that the channel iron, formed by rolling an endless band, is cut to the length of two jambs and the lintel, measured on the outer side of the channel of the finished door frame. At the location of bends of the corners there are provided a cut-out shape, as a triangle, and then two further cut-outs, as above described, formed as trapezoids. Then by means of a tool having a cutting edge following the shape of the channel iron and held perpendicular to the frame of the channel iron, forming the inner side of the door frame, the surface of the channel iron, lying in the plane of the channel iron, forming the inner part of the door frame even in the planes being parallel to it and limited by the hypotenuse of the cut-out shaped as a rectangular isosceles triangle, eventually by a base of the cut-outs shaped as an isosceles trapezoid, is to be deviated a little in the direction opposite to the direction of the next bend of the channel iron into the shape of an inverted U to form the frame. Simultaneously, the sections of the channel iron, which have been deflected a little in advance, are deflected into the counter-direction of the main bends of the door frame so that they form double-walled formations which, after their sides have been pressed together, form tongues, which lie at an angle of 135° with respect to the plane of the respective jamb and the lintel of the frame.

It is also advantageous to bend the tongues into the plane of the header or lintel so that they form its prolongation, eventually to bend the tongues alternatingly to the adjacent jamb and to the lintel.

It is also advantageous to bend at least one tongue into the plane of the upper part so that it forms its elongation and then to bend the remaining tongues alternatingly to the adjacent jamb and toward the lintel. The advantage of the door frame made of channel iron open to the outside according to the invention resides in the fact that both jambs and the header or lintel are made from an integral, unseparated material by bending, instead of connecting three separate parts in one connected member as has been done up until now. In this way, the electric power necessary to form the frame is decreased with respect to welded door frames, and the formerly used connecting members such as special corner junction pieces are eliminated as well. The requirements for work as to the preparation of individual parts, e.g. cutting to length and connecting operations, including the removing of flash after welding, are also decreased when manufacturing metal door frames made of channel iron open from the outside in accordance with the invention.

Examples of embodiments made of door frames formed of channel irons open to the outside according to the invention are shown in the attached drawings, wherein.

Figure 3:
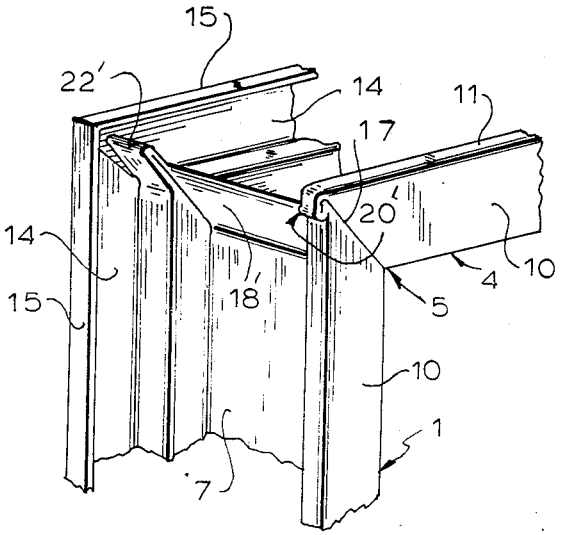
FIG. 3 is a view in isometric projection of an embodiment of a door frame corner as the tongues thereof appear after the bend has been formed in accordance with the invention.
Figure 4:
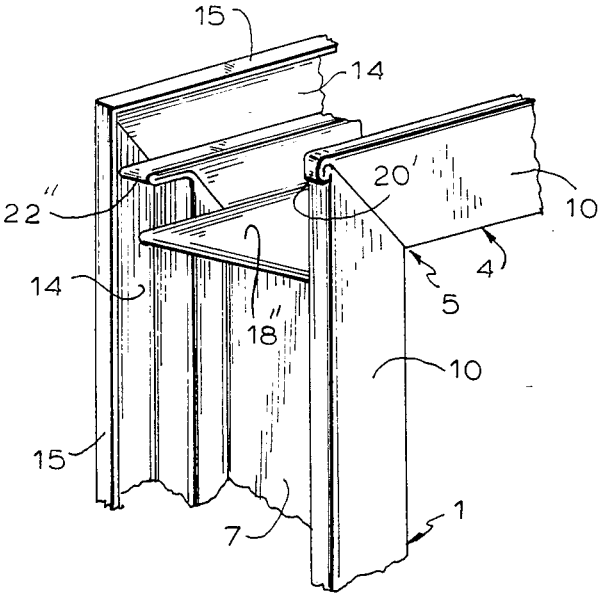
Figure 5:
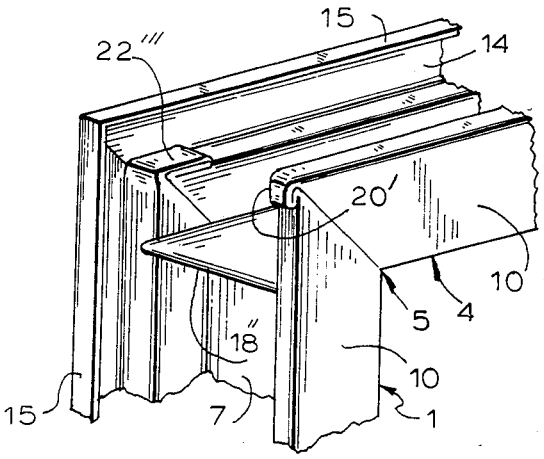

FIG. 4 is a view in isometric projection of an embodiment of the door frame corner such as shown in FIG. 3 after the tongues thereof have been bent to lie into the plane of the lintel or header or at least parallel thereto; and FIG. 5 is a view in isometric projection of a door frame corner such as that of FIG. 3 after the upper tongue thereof has been bent to lie inwardly of the frame and parallel to the plane of the header or lintel thereof.

Figure 1:
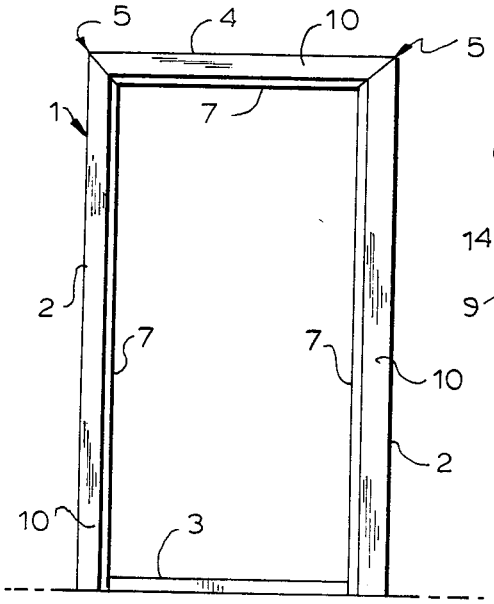
FIG. 1 is a view in front elevation of a door frame made in accordance with the invention.
Figure 2:
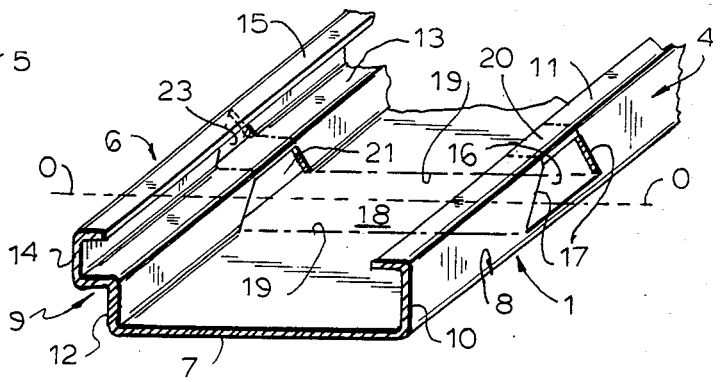
FIG. 2 is a view in isometric perspective of a part of a channel iron as it is prepared before its being bent to form a part of the frame.

Turning first to FIG. 1, the door frame 1 there shown has two jambs 2, a sill 3, and a header or lintel 4. The jambs 2 and the header or lintel 4 are made from an integral length of channel iron 6 having a cross-sectional shape as shown in FIG. 2. The jambs 2 and the header 4 are connected by corners 5, as shown.

In the following description of the section, as shown in FIG. 2, the directions of the various parts of the section are given as they appear in that figure. It is, of course, to be understood that the parts thereof occupy different positions as the section 6 is bent to form the two jambs 2 and the header or lintel 4 of the door frame 1 shown in FIG. 1. Turning now to FIG. 2, it will be seen that the channel iron 6 is generally in the shape of a broad U having a broad flat or plane bottom 7, and that it is asymmetrical in section, that is, the formations on the opposite edges of the bottom 7 being of different shapes. The first edge formation 8 is disposed at the right in FIG. 2, and the second edge formation 9, is disposed at the left in FIG. 2. Formation 8 is made up of a first upright edge portion 10, and an inbent horizontal upper flange portion 11. The left-hand edge formation 9 is made of a second upright edge portion or flange 12. An outwardly bent horizontal flange 13 extends from the top of flange 12; from the outer edge of flange 13 there extends upwardly a third upright edge portion 14. Finally, from the upper edge of portion 14 there extends an upper inbent flange 15.

The portion of the channel 6 shown in FIG. 2 has been prepared for being bent generally about a bending line O—O through an angle of 90° between successive parts of the channel. In FIG. 2 it is indicated that the portion of the channel 6 closer to the rear is to be bent downwardly by being turned counter-clockwise with respect to the rear portion of the channel so that the first portion of the channel will form, for example, a jamb 2 whereas the rear portion of such channel will form the header or lintel 4 of the door frame 1.

Symmetrically disposed with respect to the bending line O—O an opening 16 of isosceles trapezoidal shape has been formed through the first upright edge part 10 of the channel. The opposite side edges 17 of such trapezoidal opening extend in opposite directions, converging upwardly toward each other, at angles of 45° with respect to the base of the trapezoidal opening. Such base of the trapezoidal opening lies at the intersection between the broad bottom surface 7 and the upright part 10 of the channel. The upper boundary of the opening 16 lies at the intersection of the part 10 of the channel with the inbent upper flange 11 attached to the upper part of part 10 of the channel. Imaginary lines 19, disposed transversely of the channel and extending inwardly across it from the lower corners of the trapezoidal opening 16 define a panel portion 18 of the main base part 7 of the channel. Imaginary transverse lines extending from the upper corners of the trapezoidal opening 16 across the inbent upper flange 11 define a panel 20 in such flange 11. The panels 18 and 20, as will be seen below, will be bent respectively generally along line O—O and along a transverse line disposed centrally longitudinally of the flange 11 upon the bending of the forward part of the channel 6 as shown in FIG. 2 with respect to the rear part thereof.

A second opening 21, of isosoceles trapezoidal shape, is made in the vertical flange 12 of formation 9. The opposite lower corners of opening 21 are disposed upon the transverse lines 19. The opposite inclined edges of opening 21 converge in an upward direction, such inclined edges extending at angles of 45° with respect to the plane of the part 7 of the channel. The height of the opening 21 is somewhat less than that of opening 16, since the upper edge of opening 21 is disposed at the intersection between flanges 12 and 13. Imaginary lines extending transversely of the flange 13 from the upper corners of the trapezoidal opening 21 define a panel 22 in flange 13. Panel 22 is likewise bent along a transverse line disposed centrally longitudinally of the panel, when the two parts of the channel 6 are bent with respect to each other, as above described.

A third opening 23, of isosceles triangular shape, is made in the third upright flange or edge portion 14. The base of opening 23 has its opposite corners disposed upon said imaginary transverse lines which define the panel 22 in flange 13. The apex of the opening 23 lies at the intersection of the flanges 14 and 15 of the formation 9. It will be seen that a vertical transverse plane containing the bending line O—O passes centrally through the openings 16 and 21, centrally through the panels 20 and 22, and through the apex of the isosceles triangular opening 23 in the flange 14.

FIG. 3 illustrates the corner 5 of the frame of FIG. 1 between the left-hand jamb 2 and the header 4 which results from performing the bending operation which was above described with reference to FIG. 2. It will be seen that the side edges 17 of the opening 16 in the front part 10 of channel 6 are in abutment in FIG. 3. The panel 20 in flange 11 of formation 8 has been bent downwardly into a fold 20'. The panel 18 defined between lines 19 on the main broad portion 7 of channel 6 is folded into a double-walled formation 18' which extends upwardly and to the left in the plane of the abutting edges 17 which extends at 45° with respect to the vertical, that is, with respect to the length of the jamb 2. A fold 22' is formed from panel 22 of flange 13 which forms a part of the formation 9 of the channel 6.

In the corner of the door frame 1 shown in FIG. 4 the parts remain the same as in FIG. 3 and are similarly designated with the exception that the formation 18' of FIG. 3 has now been bent downwardly to lie in a horizontal plane and that the formation 22' of FIG. 3 has been similarly bent. Such formations are designated, respectively, 18'' and 22'' in FIG. 4.

In FIG. 5 the corner of the frame there shown is the same as that in FIG. 4 with the exception that the formation 22' of FIG. 3, which was folded outwardly to form formation 22' in FIG. 4, has instead been folded laterally inwardly to lie horizonal, as shown at 22''' in FIG. 5. It will thus be seen that formations 18' and 22''' of FIG. 5 extend in opposite directions: formation 18'' lies adjacent the jamb 2, whereas formation 22''' lies adjacent the header 4.

In an unillustrated further embodiment of the frame in accordance with the invention, the formation 20' extends to the left in FIG. 5, rather than being folded downwardly as shown, so that it lies in the plane of the upper edge of the header 4, and the other two formations (18' and 22' as designated in FIG. 3), lies close alternatingly to the adjacent jamb 2 and the header 4, respectively.

A method of manufacturing a metal door frame in accordance with the invention, made of a channel iron open to the outside resides in rolling an endless band into the shape of channel iron 6. The channel iron is cut to the length of two jambs 2 and one header 4. This length is measured on the outer side of the channel iron 6 of a finished door frame. In the area of the bend of the corners of the door frame one cuts in the first perpendicular wall 14 of a still straight channel iron 4 cut-outs shaped as an isosceles rectangular triangle 23, and in the second perpendicular wall 12 of formation 9 and the perpendicular wall 10 of the formation 8 of the still straight channel section 6 one cuts out isosceles trapezoidal openings 21 and 16, respectively. Then, by means of a tool having a cutting edge following the shape of the channel 6 and being perpendicular to the plane of the channel 6, forming the inner side 7 of the door frame. The center of the surfaces of the panels 18, 20, and 22, lying in the plane of the channel iron 6, forming the inner side 7 of the door frame and in planes parallel to it, is deviated a little in the direction opposite to the direction of the next bend of the channel section 6 into the shape of the door frame.

The channel section 6, prepared in this way, is then bent in the area of the corners 5 of the door frame into the shape of an inverted U. In this operation the surfaces 18, 20, and 22 are deviated slightly into the counterdirection of the main bends of the door frame and they form folds. By pressing the sides of the folds, double-walled formations 18', 20' and 22' are produced, which form an angle of 135° with the plane of the jamb 2 and with the plane of the header 4. To the main part of the door frame prepared in this way, the sill 3, formed separately, is attached in an ordinary manner.

Another method of manufacture of the metal door frame made of channel iron open from the outside, in accordance with the invention, differs from the above-described method in that the formations 18', 20' and 22', which arise at the corners 5 of the door frame, are bent in the plane of the header 4 in such a way that they form a prolongation thereof.

Another method of manufacture of the metal door frame made of channel iron open to the outside differs from the abovementioned methods in that the formations 18', 20', and 22', formed at the corners 5 of the frame, are bent alternatingly to contact the adjacent jamb 2 and the header 4.

The fourth method of manufacture of the metal door frame made of channel iron open to the outside differs from the ones abovedescribed in that the formation 18', formed from the panel 18, being in the plane of the channel iron 6 and forming the inner side 7 of the door frame, is bent in the plane of the header 4 in such manner that it forms a prolongation thereof, the other two formations 20' and 22' are then alternatingly bent into contact with the adjacent jamb 2 and the header 4.

By bending formations 18', 20', and 22' according to the above-described second, third, and fourth methods of manufacture the corners 5 of the door frame are locked.

The formations 18', 20', and 22', protruding in the frame of the header 4 of the door frame serve as effective anchors for building the frame into the masonry of a building.

The invention may also be applied when manufacturing window frames for buildings, when manufacturing various frames as for filters and the like, and for foundations for machines and so forth.

Although the invention is described and illustrated with reference to several embodiments thereof, it is to be expressly understood that the invention is in no way limited by the abovedescribed embodiments thereof, but that it may be applied in numerous other embodiments within the scope of the appended claims.

We claim:

1. A method of manufacture of a metal door frame made of a channel iron open from outside, which is formed by rolling an endless band, wherein the rolled channel iron is cut to the length of two jambs and a header, measured on the outer side of the channel iron of the finished frame, in the spot of bends of corners one cuts, in an unfolded state of the corner, straight-sided openings having up to four sides, two of which converge toward each other, by means of a tool having an edge following the shape of the channel iron and perpendicular to the plane of the channel iron, forming the inner side of the frame, the center of the surfaces of the channel irons, limited by the length of the hypotenuse of the said straight-sided openings and lying in the plane of the channel iron, forming the inner side of the frame and in planes being parallel to it is to be deflected a little in the direction being opposite to the direction of the next bend of the channel iron into the shape of the frame, then the channel iron is bent in the area of corners of the frame into the shape of an inverted U, simultaneously the surfaces of the channel iron, which have been deflected a little in advance, are deflected into the counterdirection of the main bends of the frame and they form a double-walled structure, which after its sides have been pressed, forms tongues disposed at an angle of 135° to the plane of the jamb and of the header.

2. A method of manufacture of a metal frame as in claim 1, wherein the tongues, formed in the corners of the frame, are bent out into the plane of the header.

3. A method of manufacture of a metal frame as in claim 1, wherein the tongues, formed in the corners of the frame, are alternatingly bent into contact with the adjacent jamb and the header.

4. A method of manufacture of a metal frame as in claim 1, wherein at least one tongue, formed in the corners of the frame, is bent out into the plane of the header and other tongues are alternatingly bent into contact with one of the adjacent jambs and the header.

5. A metal frame made of channel iron open from outside, said frame having jambs, a sill and a header, both jambs and the header being made of a single length of the channel iron bent into the shape of an inverted U, the channel iron from which the frame is made being asymmetrical in cross-section, such cross-section being generally in the shape of a broad U, when the broad U of the channel iron is in upright position the broad bottom of the U is at least generally flat or plane, and forms the portions of the parts of the door frame which are to define the opening therethrough, arising from a first longitudinal edge of such bottom of the channel there being a second upright longitudinally extending flange of somewhat less height than the first vertical flange on the first edge of the channel, from the upper edge of such second upright flange there extending laterally outwardly a second, horizontal longitudinally extending flange, from the outer edge of such second, laterally outwardly extending flange there rises a third, shallow upright flange portion of the channel, such third shallow upright flange portion of the channel, such third upright portion of the channel terminating in a third horizontal laterally inwardly extending longitudinal flange, the forward and rear parts of the jambs and header of the frame meeting along single closed angularly disposed lines, excess metal portions in the channel iron between the forward and rear portions of the frame, said excess metal portions being formed into frame strengthening folded tongues, and wherein before the bending of the channel iron to form the jambs and header of the frame the length of the channel iron which is to form the frame is prepared by providing a first opening, in the first vertical flange, in the form of an isosceles trapezoid having its lower and upper boundaries parallel and disposed respectively at the upper surface of the broad main bottom portion of the channel and the junction between the first upright wall or flange of the channel and the first inwardly bent horizontal flange thereon, the sides of such isosceles trapezoid being inclined in opposite directions so as to converge upwardly, such sides forming angles of 45' with respect to the broad horizontal base of the channel, said first isosceles trapezoidal opening being disposed in the first upright flange of the channel generally centrally with respect to a transverse line of bend across the channel, in the second, opposite upright flange, disposed on the other edge of the main bottom part of the channel, there being formed a second opening of isosceles trapezoid shape which is similar to the isosceles trapezoid opening in the first upright flange on the channel and is located in the same manner but laterally opposite to, the first isosceles trapezoid opening differing from the first such opening in that it is of lesser height than the first such opening, the bottom of the second isosceles trapezoid opening being located at the juncture between the main bottom portion of the channel and the second upright flange thereon, and the upper edge of the second isosceles trapezoid opening being located at the junction between the second upright flange on the channel and the second, outwardly bent longitudinally extending flange thereon, the second isosceles trapezoid opening being located symmetrically with respect to said transverse line of bend to be made in the channel, and the opposite generally vertically extending walls thereof upwardly converge at equal opposite angles of 45° with respect to the main bottom portion of the channel, a third opening, of isosceles triangular shape, being disposed in the third upright flange portion which extends longitudinally of said second side edge of the channel, said isosceles triangular opening extending from its base at the junction between the second laterally extending flange on the channel to the apex of such opening disposed at the intersection between said third upright flange thereon and the third inwardly extending horizontal flange at said second edge of the channel, the isosceles triangular opening having its apex disposed in the vertical transverse plane through the channel section which contains the line of the bend to be made therein as well as the center points of the bases of the abovedescribed openings of isosceles trapezoidal shape made in the first and second vertical longitudinally extending flanges of the channel.

6. A metal frame as in claim 5, wherein the surface of the channel iron lying at the corners of the frame in the plane of the channel iron, forming the inner side of the door frame, lying in planes parallel to the plane of the channel iron, and limited by the length of the hypotenuse of the opening shaped as an isosceles triangle, and also by the bases of the openings shaped as isosceles trapezoids, form in the corners of the frame tongues forming an angle 135° with the adjacent jamb and with the upper part.

7. A metal frame made of channel iron open from outside, said frame having jambs, a sill and a header, both jambs and the header being made of a single length of the channel iron bent into the shape of an inverted U, the channel iron from which the frame is made being asymmetrical in cross-section, such cross-section being generally in the shape of a broad U, when the broad U of the channel iron is in upright position the broad bottom of the U is at least generally flat or plane, and forms the portions of the parts of the door frame which are are to define the opening therethrough, arising from a first longitudinal edge of such bottom there is a first upright flange and then a first horizontal laterally inwardly bent flange, on the second other edge of the broad bottom of the channel there being a second upright longitudinally extending flange of somewhat less height than the first vertical flange on the first edge of the channel, from the upper edge of such second upright flange there extending laterally outwardly a second, horizontal longitudinally extending flange, from the outer edge of such second, laterally outwardly extending flange there rises a third, shallow upright flange portion of the channel, such third upright portion of the channel terminating in a third horizontal laterally inwardly extending longitudinal flange, the forward and rear parts of the jambs and header of the frame meeting along single closed angularly disposed lines, excess metal portions in the channel iron between the forward and rear portions of the frame, said excess metal portions being formed into frame strengthening folded tongues, wherein before the bending of the channel iron to form the jambs and header of the frame the length of channel iron which is to form the frame is prepared by providing a first opening, in the first vertical flange, in the form of an isosceles trapezoid having its lower and upper boundaries parallel and disposed respectively at the upper surface of the broad main bottom portion of the channel and the junction between the first upright wall or flange thereon, the sides of such isosceles trapezoid being inclined in opposite directions so as to converge upwardly, such sides forming angles of 45′ with respect to the broad horizontal base of the channel, said first upright flange of the channel generally centrally with respect to a transverse line of bend across the channel, in the second, opposite upright flange, disposed on the other edge of the main bottom part of the channel, there being formed a second opening of isosceles trapezoid opening in the first upright flange on the channel and is located in the same manner but laterally opposite to, the first isosceles trapezoid opening, the bottom of the second isosceles trapezoid opening being located at the junction between the second upright flange on the channel and the second, outwardly bent longitudinally extending flange thereon, the second isosceles trapezoid opening being located symmetrically with respect to said transverse line of bend to be made in the channel, and the opposite generally vertically extending walls thereof upwardly converge at equal opposite angles of 45° with respect to the main bottom portion of the channel.

* * * * *